United States Patent [19]

Jenks, Jr. et al.

[11] Patent Number: 4,999,845

[45] Date of Patent: Mar. 19, 1991

[54] WET SUIT

[75] Inventors: James E. Jenks, Jr., Dana Point; Howard A. Barmazel, Northridge, both of Calif.

[73] Assignee: Ocean Pacific Sunwear Ltd., Tustin, Calif.

[21] Appl. No.: 407,444

[22] Filed: Sep. 14, 1989

[51] Int. Cl.[5] ..... A41B 13/00; A41B 7/00; B63C 11/02

[52] U.S. Cl. ..... 2/2.1 R; 2/67; 2/2; 2/82; 2/DIG. 5

[58] Field of Search ..... 2/2.1 R, 67, 2, 82, 2/DIG. 5; 441/102, 106, 107

[56] References Cited

U.S. PATENT DOCUMENTS

| | | | |
|---|---|---|---|
| 202,976 | 11/1965 | O'Neill | D3/17 |
| 1,706,097 | 2/1927 | Aud . | |
| 2,582,811 | 1/1952 | Williams | 2/2.1 |
| 2,981,954 | 5/1961 | Garbellano | 2/2.1 R |
| 3,493,972 | 12/1967 | Oldham | 2/2.1 |
| 3,731,319 | 5/1973 | O'Neill | 2/2.1 R |
| 3,744,052 | 7/1973 | Rector | 2/2.1 R |
| 3,763,498 | 10/1973 | Rector | 2/2.1 R |
| 3,771,169 | 11/1973 | Edmund | 2/2.1 R |
| 4,293,957 | 10/1981 | Melarvie | 2/2.1 R |
| 4,741,050 | 5/1988 | O'Kane et al. | 2/2.1 R |
| 4,809,364 | 3/1989 | Lent | 2/2.1 R |
| 4,862,517 | 9/1989 | Meistrell | 2/2.1 R |
| 4,907,295 | 3/1990 | Yasuda | 2/2.1 R |

FOREIGN PATENT DOCUMENTS 1473129 2/1967 France .

OTHER PUBLICATIONS

U.S. Federal Supply Service, *Stitches, Seams and Stitchings*, Fed. Std. No. 751; Stitch Type 607; (Aug. 14, 1959).

*Primary Examiner*—Werner H. Schroeder
*Assistant Examiner*—Glona Hale
*Attorney, Agent, or Firm*—Brown, Martin, Haller & McClain

[57] ABSTRACT

A one-piece wet suit comprises a continuous body portion having a neck opening, arm openings and leg openings, the suit being formed from panels of a first, insulative material and panels of a second material having higher elasticity than the first material. The second material extends around at least part of the neck opening to allow the suit to be pulled on or taken off over the body of a wearer via the neck opening.

16 Claims, 3 Drawing Sheets

WET SUIT

BACKGROUND OF THE INVENTION

The present invention relates generally to articles of clothing, and is particularly concerned with wet suits of the type used in water sports such as surfing, sail boarding (wind surfing), diving and swimming.

Most wet suits are made of relatively thick, insulative material such as neoprene and have zippers or other fasteners extending down the back or front to enable a person to don or remove the wet suit. However, these fasteners are uncomfortable and relatively inflexible, which can cause problems when the water sport involves repeated crouching or bending movements, as is typically the case with surfing, for example. Also, they can easily weaken, jam or break after repeated use, requiring repair or replacement.

SUMMARY OF THE INVENTION

It is an object of the present invention to provide an improved wet suit which is easy to put on and take off and which is comfortable to wear for any water sport activity.

According to the present invention, a one-piece wet suit is provided which comprises a continuous body portion having a neck opening, arm openings and leggings, the body portion being formed from panels of two different types of material having different elasticity, the panels being permanently secured together along all their adjacent edges, and the material having higher elasticity extending around at least part of the neck opening for allowing the suit to be pulled on over the body of a wearer via the neck opening.

In the preferred embodiment of the invention, arm opening panels of the higher elasticity material extend between each arm opening and the neck opening and around the periphery of each arm opening. The central part of the body portion is of the material having lower elasticity which is an insulative material such as Neoprene. The insulative material is thicker than the higher elasticity material. Part of each legging may be of the higher elasticity material to provide better stretchability when surfing or sail boarding, for example, when the wearer must often adopt a crouching position. The adjacent panels are all permanently secured together by stitching. In the preferred embodiment of the invention, the stitching is a modified flat lock machine stitch utilizing a fluffed thread with substantially no gaps between adjacent stitches at least on the outer surface of the suit.

Since the more elastic or stretchable material, which may be a nylon/Lycra mix or other equivalent elasticity material, is provided around at least part of the neck opening, the neck can be stretched to provide a sufficiently large opening for the wearer to step into the suit via the neck opening, and then pull the suit up over the body, inserting arms and legs through the appropriate openings. By providing stretchable material around the arms, the arm openings can be similarly stretched to allow the arms to be inserted easily through the arm openings. The procedure is reversed when the suit is taken off. The arm and neck openings may be enlarged slightly to dimensions larger than normal in the relaxed or unstretched condition, if necessary. When the neck opening is stretched to the maximum extent the suit can be easily donned or taken off. The procedure is reversed to take off the suit. Thus, a continuous one piece body covering suit is provided with no fastenings or zippers which could cause discomfort or which could potentially jam or break. The suit is quick and easy to put on or take off, requiring minimum effort.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
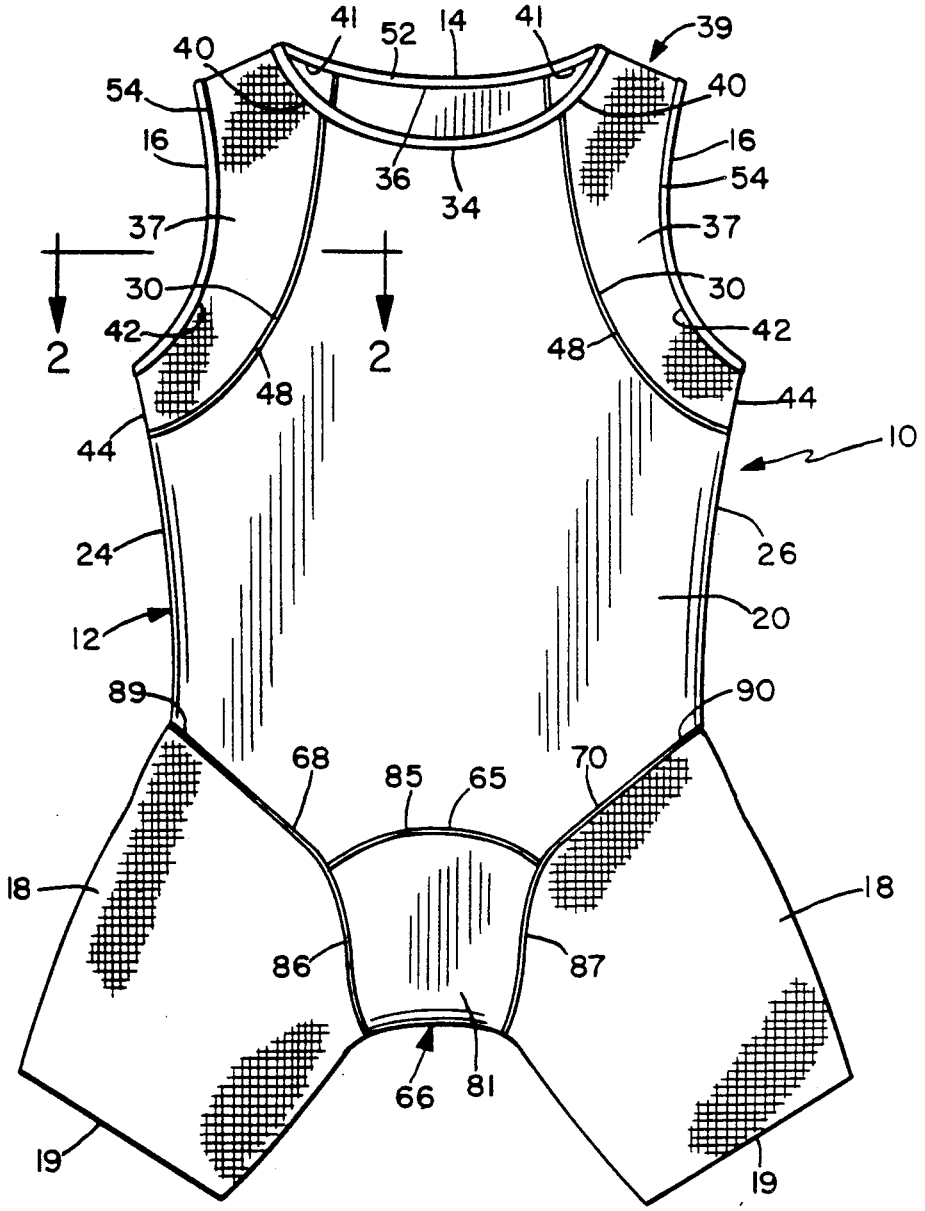
FIG. 1 is a front elevation view of a wet suit according to a preferred embodiment of the invention.

The drawings illustrate a preferred embodiment of a one-piece wet suit 10 according to the invention. As illustrated, the suit 10 comprises a continuous, integral body or trunk portion 12 having a neck opening 14 at its upper end, arm openings 16 at its sides, and a pair of tubular leggings 18 integral with the body portion and having leg openings 19 at their lower ends. In alternative embodiments the leggings may be of any desired length, or may be omitted and replaced with simple leg openings at a location corresponding to the upper end of the wearer's legs.

The suit 10 is made from suitably shaped, co-operating panels of two different types of material having different elasticity which are all permanently sewn together at their adjacent edges to form a continuous, one-piece suit. The two materials comprise a first elastomeric material having insulating properties, such as Neoprene or the like, and a second elastomeric material which is thinner and more stretchable or elastic than the first material. The second material may be a Nylon/Lycra material or a similar lightweight and stretchable material. The insulative material is designed to cover a major portion of the torso or body while the more elastic material surrounds at least part of the neck opening and the arm openings. In the preferred embodiment illustrated, the more elastic material is also provided around a substantial part of the leggings 18.

Figure 2:
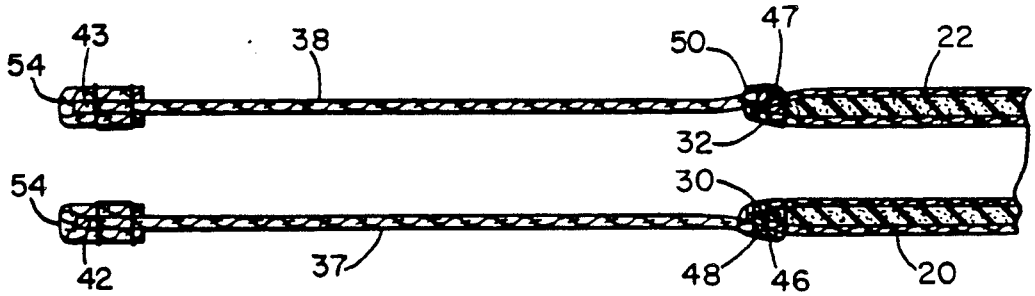
FIG. 2 is an enlarged sectional view taken on line 2—2 of FIG. 1.
Figure 3:
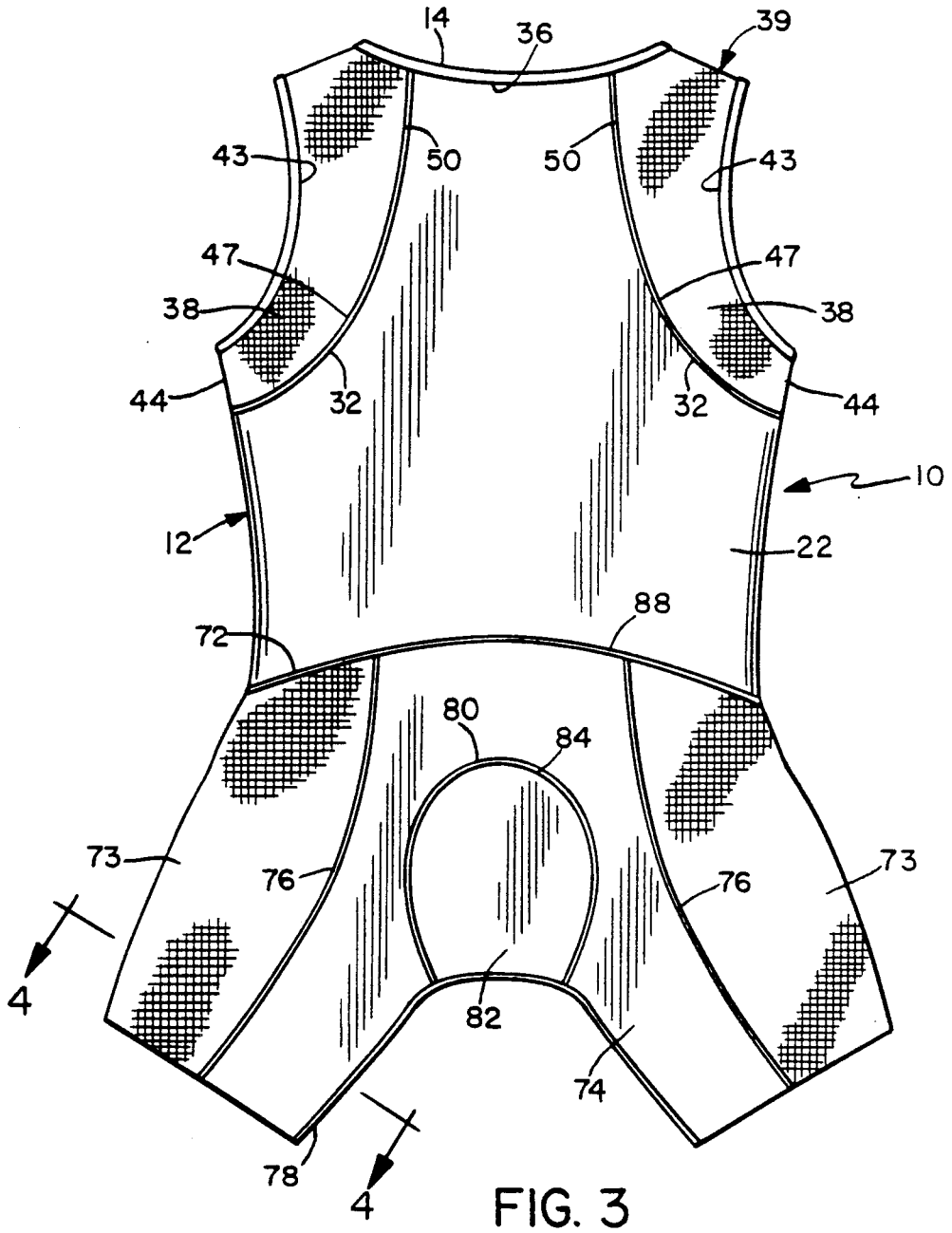
FIG. 3 is a rear elevation view of the wet suit.
Figure 5:
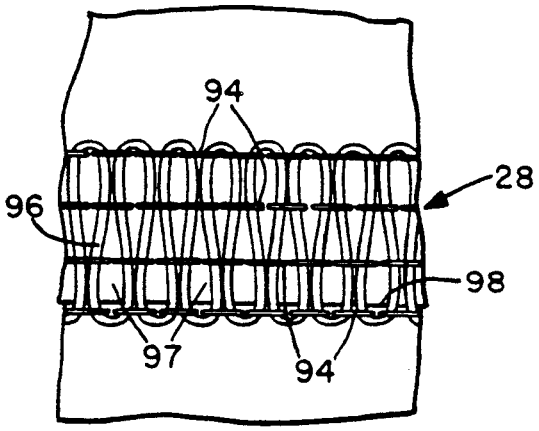
FIG. 5 is an enlargement of a typical stitch used in wet suit construction.

As best illustrated in FIGS. 1 to 3, the mid-portion and part of the upper portion of the body is formed from front and rear body panels 20,22 of the first, insulating material. The panels 20,22 are suitably secured together along their adjacent, abutting straight side edges 24,26 via stitching lines or seams (not visible in the drawings), which may be of a standard flat lock stitch 28 as illustrated in FIG. 5. The panels each have arcuate cut outs 30, 32 on each side above the side seams which encircle the shoulder regions but are inset from the desired position of the arm opening. The upper edges 34,36 of the front and rear panels are of scooped shape to form part of the neck opening.

The shoulder regions and arm openings of the suit are formed in panels of the second material which are secured to the cut out edges 30,32 of the front and rear panels. Each shoulder region is formed by front and rear shoulder panels 37, 38 of the second, more stretchable material. Each pair of front and rear shoulder panels have upper edges which abut along part of their length extending across the shoulder region 39, and which are shaped along the remainder 40,41 of their length to form a continuation of the neck opening at the front and rear of the suit, respectively, when secured to the respective front and rear body panels. The outer side edges of each pair of shoulder panels are shaped along an upper portion 42, 43 to form the desired arcuate arm opening shape, while the lower portions 44 abut to from a continuation of the side seams. The abutting portions of the upper and outer side edges are secured together by suitable stitching lines or seams (not visible in the drawings).

The inner side edges 46, 47 of each front and rear shoulder panel are shaped to conform to the shape of the arcuate cut out edges 30, 32 of the respective front and rear body panels 20, 22 on each side of the suit, and the convex and concave edges of the shoulder and body panels, respectively, are overlapped and sewn together by stitching lines or seams 48, 50 on the front and rear of the suit, respectively, as best illustrated in FIG. 2. Once the body and shoulder panels have been sewn together, binding 52, 54 is sewn around the neck opening and each arm opening, respectively. In the preferred embodiment of the invention, the binding is of identical or similar material to the second, stretchable material used for part of the suit, for example a ⅜ inch binding of Nylon/Lycra material.

The lower part of the suit is also formed from panels of the two different materials. The front body panel 20 extends down to the top of the crotch region 66 at the center 65 and is arched upwardly on opposite sides 68, 70 so that it generally follows the hip line of the wearer. The lower end or edge 72 of rear body panel 22 terminates just above the hip region so that it forms a continuous line with the sides 68,70 of lower edge of the front panel when these two panels are sewn together along the side seams.

Figure 4:
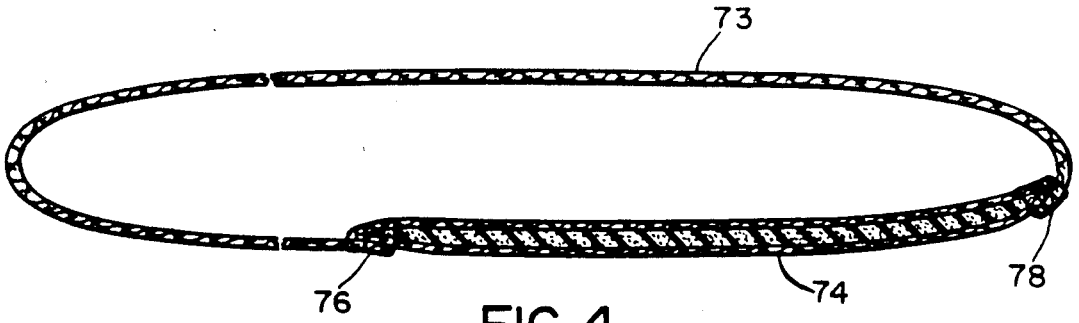
FIG. 4 is an enlarged sectional view taken on line 4—4 of FIG. 3.

The crotch or lower torso region and leggings of the suit depend downwardly from the lower edges of the front and rear body panels. Each legging is formed from a panel 73 of the second, more stretchable material and a panel 74 of the first, insulative material which are sewn together along seam lines 76,78 along their abutting side edges to form tubular leggings, as best illustrated in FIG. 4, with leg openings 19 at their lower ends. The panels 73 of stretchable material extend around the front and outer half of the rear of each leg region, and cover about ⅔ to ¾ of the periphery of the legging, to provide good "bendability" or stretch. Since the entire front of the thigh region of the wearer will be covered by the more stretchable material, they will be able to bend and stretch more easily during activities such as surfing. The insulative portions of each legging are provided by a single panel of the insulative material which extends across the back above the crotch region between the leggings as illustrated in FIG. 3, and downwardly at each side to form the inner halves of the rear of each legging. The single panel 74 has an upwardly arched lower edge 80 between the leggings which surrounds the rear crotch region.

The crotch region 66 is preferably formed by separate front and rear crotch panels 81, 82 of the insulative material which are secured together along their abutting lower edges via a continuation of the legging seams 78 (see FIG. 3). The rear crotch panel 82 is shaped along the remainder of its length to conform with the shape of the arched lower edge 80 of legging panel 74, against which it abuts and is secured via stitching line 84. The upper edge of the front crotch panel is secured via stitching line 85 to the center part 65 of the lower edge of the front body panel, while its side edges 86, 87 are shaped to form continuations of the arched lower edge regions 68, 70 of the front body panel 88.

The upper edges of the legging panels are secured to the lower edge of the rear body panel via stitching line or seam 88 (see FIG. 3), and are secured to the front body and crotch panels via stitching lines 89, 90 (see FIG. 1) In practice, a continuous line of stitching is used to secure the leggings to outer side edges of the front crotch panel, the lower edges of the front panel, and the lower edge of the rear panel (i.e. stitching lines 88, 89, and 90 are formed by a single, continuous line of stitching). Similarly, the inner legging seams 78 and lower crotch seam may comprise a single, continuous line of stitching as illustrated in the drawings. Suitable stitching or binding material is provided around the leg openings 19, for example a baby overlock stitch, and a length of gripper elastic may be sewn around the inner periphery of each leg opening 19 if desired, to provide a better fit.

The panels of the two different materials will be of different thickness, with the panels of insulative material generally being significantly thicker than the panels of more stretchable material. For example, neoprene material with a thickness in the range from 1.5 to 2.0 mm. may be used for the panels of the first, insulating material while the more stretchable material may comprise Nylon/Lycra material of 0.5 to 1.0 mm. thickness. In order to avoid or reduce any discomfort at the thickness transitions between the panels of different materials, and provide a smoother transition, a special type of stitching is used to join their overlapping edges together, as best illustrated in FIGS. 2, 4, 6 and 7. This stitching also has the advantage of providing a smoother, more continuous appearance at the seam lines with the material edges being more or less invisible, improving the appearance of the suit. In the preferred embodiment of the invention, all of the stitched seams comprise modified flat lock stitching. The stitching is done using a standard flat lock stitching machine with modifications as explained below. In the preferred embodiment of the invention, a Union Special 36200 AJ stitching machine was used. In this machine, six cones of thread are normally used to produce a standard flat lock stitch as illustrated in FIG. 5. This stitch basically comprises four parallel rows 94 of straight stitching extending through the material, with zig-zag or serpentine transverse or cross stitches 96 on each side of the material which is looped under the stitches in adjacent parallel rows to link the parallel rows. As seen in FIG. 5, gaps 97 between the adjacent stitches leave the abutting material edges 98 visible. Where there is a significant thickness transition between the materials, this edge is prominent and may also result in some discomfort since the edges of the thicker material panels on the inside of the suit will be felt by the wearer and could potentially cause some abrasion as the wearer bends and stretches.

Figure 6:
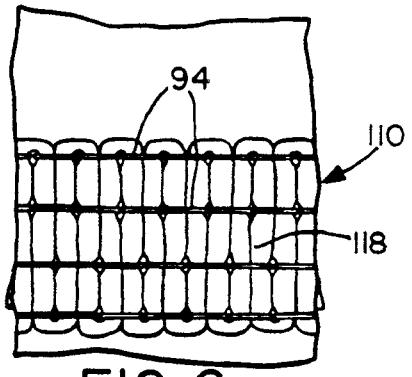
FIG. 6 is an enlargement of the outside of a seam using the novel stitch with additional fluffing to fill gaps.
Figure 7:
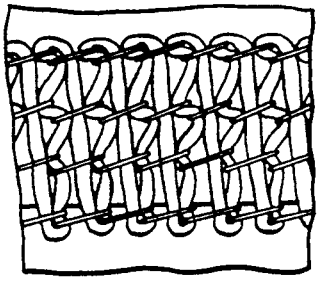
FIG. 7 is an enlargement similar to FIG. 6 showing the inner side of the seam.
Figure 8:
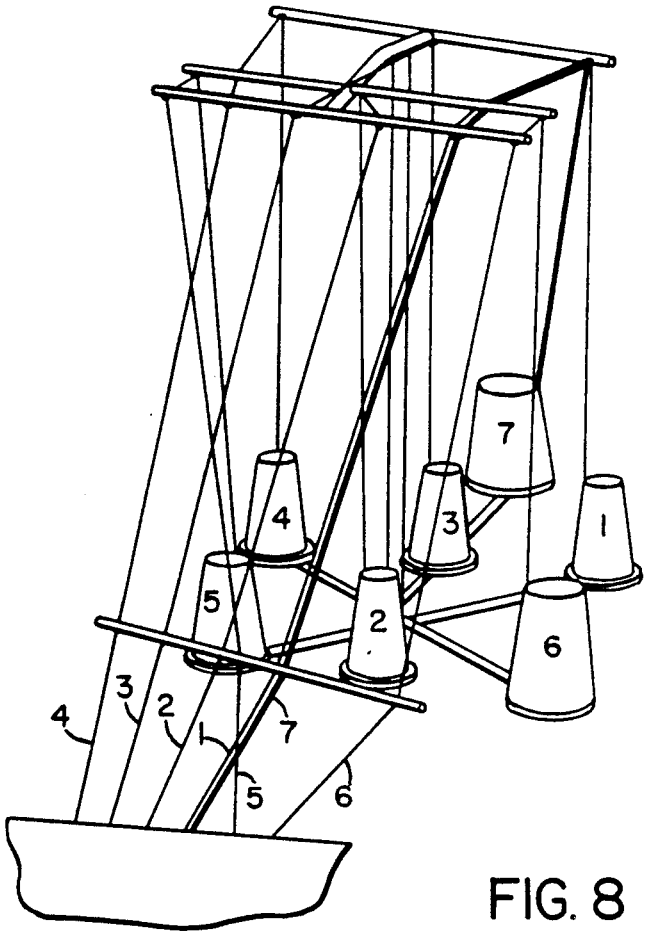
FIG. 8 schematically illustrates the arrangement of thread feeds used to make the stitch, with the additional fluffing thread incorporated.

In the preferred embodiment of this invention, potential discomfort at the seam lines is reduced or eliminated and at the same time the overall appearance of the suit is improved by using the modified flat lock stitch 110 illustrated in FIGS. 6 and 7. FIG. 6 illustrates the stitch as it appears on the outer face of the suit while FIG. 7 illustrates the inside face. The stitch 110 is used to connect at least all of the overlapped edges between adjacent panels of the two different types of material. However, the modified stitch may be used for all of the seams of the suit if desired. The stitch illustrated in FIGS. 6 and 7 is formed as generally illustrated in FIG. 8. FIG. 8 illustrates the standard 6 cones 1 to 6 of a Union Special, 36200 AJ stitching machine. In order to produce stitch 110 of FIG. 6, an additional cone of thread 7 is added, and thread 7 is threaded through the looper (not visible in the drawings) together with the thread from the first cone 1 so that the resultant cross stitch 118 will be of doubled thread Preferably, threads 1 and 7 are both of fluffed fiber, for example a fluffed nylon thread, so that the resultant cross stitch 118 will be relatively thick and will tend to fill in the gaps. The stitch tension is adjusted until there is substantially no gap visible between adjacent stitches, at least on the outer side of the seam illustrated in FIG. 6. In order to produce the stitch illustrated in FIG. 6, the four standard cones of the stitching machine which produce the spaced parallel rows 94 of stitches carry a suitable thread such as a polyspun fiber, while the other two cones of the standard machine set up as well as the additional cone 7 carry fluffed thread, for example fluffed nylon thread. The appearance of the inside of the seam is illustrated in FIG. 7.

As illustrated, the stitches of the flat lock seams are so close together when formed that substantially no gap is present, effectively concealing the material edges from view on the front surfaces of the suit. Preferably, the yarn used for the cross stitching is of fluffed or bulked nylon, which also helps to fill in any gaps between adjacent stitches and conceal the material edges. This has the advantage of producing a smoother and cleaner look to the suit, as well as a smoother transition between the thicker neoprene panels and the thinner Nylon/Lycra panels of the suit. The other adjacent panels of the suit are sewn together in any suitable manner, for example using a standard flat lock stitch as illustrated in FIG. 5 or the modified stitch of FIG. 6.

In the preferred embodiment of the invention, the modified flat lock stitch of FIG. 6 is used at all the seams between the insulative and elastic material, with the material edges being overlapped before sewing (i.e. seams 46, 47, 88, 89, 90, 76, 78) as well as all the seams between abutting edges of the thinner, more elastic material, which are also overlapped prior to sewing (i.e. seams 30 and 44 of the shoulder panels).

The same stitch is also used for the seams connecting the lower edge of the crotch panels, which comprises a continuation of legging seam 78. However, the edges of the crotch panels are abutted, not overlapped prior to sewing. The remaining neoprene-neoprene seams 24, 26 and 85 are also formed from a flat lock stitch as in FIG. 6 to 7, except that the adjacent edges are abutted, not overlapped, and the threads are all of non-fluffed fiber such as polyspun fiber or yarn.

The one-piece wet suit of this invention is easy to don and take off, and has no releasable fasteners such as zippers or the like which could cause discomfort on wear and which may jam or break, requiring repair or replacement of the suit. It is of a much smoother, more attractive external appearance with the material edges at the seams being more or less invisible. The elasticated material panels at the leggings allow the wearer to bend their legs more easily. The stitching used at the seams reduces discomfort on the inside of the suit while improving the external appearance of the suit.

Although a preferred embodiment of the invention has been described above by way of example only, it will be understood by those skilled in the field that modifications may be made to the disclosed embodiment without departing from the scope of the invention, which is defined by the appended claims.

We claim:

1. A wet suit comprising:

a continuous body portion having a neck opening, arm openings and leg openings;

the body portion being formed from panels of a first, insulative material having a first degree of elasticity and panels of a second material having a second degree of elasticity higher than that of said first material, the panels each comprising a predetermined part of the body portion of the suit, adjacent panels of the suit having adjacent edges of mating shape and being permanently secured together along their adjacent edges; and panels of the second material extending around at least part of the neck opening and comprising means for allowing the suit to be pulled on via the neck opening.

2. The suit as claimed in claim 1, wherein panels of said second, higher elasticity material extend between the neck opening and each arm opening and around the periphery of each arm opening.

3. The suit as claimed in claim 1, wherein panels of said higher elasticity material extend around at least part of each leg opening.

4. The suit as claimed in claim 3, wherein said body portion includes a torso covering portion and leggings depending downwardly from said torso covering portion, a major part of each legging being formed from at least one panel of said second material.

5. The suit as claimed in claim 1, wherein said first material comprises a stretchable, insulative material and the second material comprises a stretchable, elastomeric material having higher elasticity than said insulative material.

6. The suit as claimed in claim 5, wherein said insulative material comprises a synthetic rubber material.

7. The suit as claimed in claim 1, wherein said panels of said first material have a first thickness and said panels of said second material have a second thickness which is less than said first thickness.

8. The suit as claimed in claim 1, wherein said adjacent panel edges are secured together by stitching.

9. The suit as claimed in claim 8, wherein said stitching between panels of different material comprises flat lock stitching.

10. The suit as claimed in claim 9, wherein said stitching is formed at least partially from threads of fluffed fiber, said fluffed fiber stitching being formed with substantially no gap between adjacent stitches at least on the outer surface of the suit.

11. An article of clothing, comprising:

panels of material each shaped to conform to the shape of respective parts of the article;

securing means for securing each adjacent pair of panels together;

at least some of said securing means between adjacent panels comprising flat lock stitching formed at least partially from threads of fluffed fiber, the fluffed fiber portions of the stitching having substantially no gaps between adjacent stitches at least on the outer surface of the article of clothing.

12. The article of clothing as claimed in claim 11, wherein said flat lock stitching includes a plurality of spaced parallel rows of stitches and transverse cross stitching linking said rows of stitches on each side of said article, the cross stitching on one side being formed from a doubled thread of fluffed fiber.

13. The article of clothing as claimed in claim 11, wherein the panels include first panels of a first material having a first degree of elasticity and thickness, and second panels of a second material having a second degree of elasticity and thickness, the first and second degrees of elasticity being different and the first and second thicknesses being different, and said flat lock stitching is provided at least between adjacent first and second panels of said different materials.

14. A seam for securing adjacent edges of two panels of material together in an article of clothing, comprising:

a series of parallel rows of straight stitches of a first thread extending through the underlying panel material;

a transverse, serpentine cross stitch on each face of the seam linking the stitches in adjacent rows, the cross stitch on at least one face comprising a doubled thread of fluffed fiber.

15. The seam as claimed in claim 14, wherein there are no gaps between adjacent turns of the serpentine cross stitch on at least said one face.

16. A seam for securing adjacent edges of two panels of material together in an article of clothing, comprising:

a series of parallel rows of straight stitches extending through the underlying panel material;

a transverse, serpentine cross-stitch on each face of the seam linking the stitches in adjacent rows; and the parallel and serpentine stitches being formed from four threads of non-fluffed fiber and three threads of fluffed fiber.

* * * * *

US004999845B1

REEXAMINATION CERTIFICATE (2003rd)

United States Patent [19]

[11] B1 4,999,845

Jenks, Jr. et al.

[45] Certificate Issued May 11, 1993

[54] WET SUIT

[75] Inventors: James E. Jenks, Jr., Dana Point; Howard A. Barmazel, Northridge, both of Calif.

[73] Assignee: Ocean Pacific Sunwear Limited, Tustin, Calif.

Reexamination Request:
No. 90/002,504, Nov. 12, 1991

Reexamination Certificate for:

| | |
|---|---|
| Patent No.: | **4,999,845** |
| Issued: | **Mar. 19, 1991** |
| Appl. No.: | **407,444** |
| Filed: | **Sep. 14, 1989** |

[51] Int. Cl.[5] ..... A41B 13/00; A41B 7/00; B63C 11/02

[52] U.S. Cl. ..... 2/2.1 R; 2/67; 2/2; 2/82; 2/DIG. 5

[58] Field of Search ..... 112/121.28; 2/2.1 R, 2/67, 2, 82, DIG. 5; 441/102, 106, 107

[56] References Cited

U.S. PATENT DOCUMENTS

| | | | |
|---|---|---|---|
| 2,981,954 | 5/1961 | Garbellano | 2/2.1 R |
| 3,731,319 | 5/1973 | O'Neill | 2/2.1 R |
| 3,744,052 | 7/1973 | Rector | 2/2.1 R |
| 3,763,498 | 10/1973 | Rector | 2/2.1 R |
| 3,771,169 | 11/1973 | Edmund | 2/2.1 R |
| 4,248,165 | 3/1981 | Addy et al. | 112/121.28 |
| 4,293,957 | 10/1981 | Melarvie | 2/2.1 R |
| 4,741,050 | 5/1988 | O'Kane et al. | 2/2.1 R |
| 4,862,517 | 9/1989 | Meistrell | 2/2.1 R |
| 4,907,295 | 3/1990 | Yasuda | 2/2.1 R |

OTHER PUBLICATIONS

U.S. Federal Supply Service, *Stitches, Seams and Stitchings*, Fed. Std. No. 751, Stitch Type 607, (Aug. 14, 1959).

Hind Product Specification Dated 1985, 2 pages.

1986 Hind Sales Catalog, Three (3) pages relating to activewear with fluffed fiber stitches.

*Primary Examiner*—Clifford D. Crowder

[57] ABSTRACT

A one-piece wet suit comprises a continuous body portion having a neck opening, arm openings and leg openings, the suit being formed from panels of a first, insulative material and panels of a second material having higher elasticity than the first material. The second material extends around at least part of the neck opening to allow the suit to be pulled on or taken off over the body of a wearer via the neck opening.

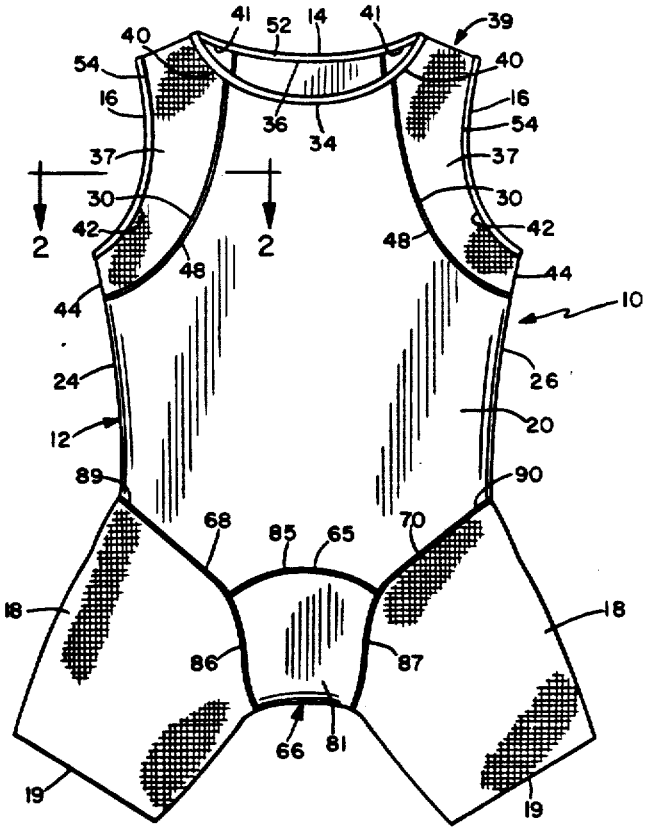

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, line 19 begins a newly inserted paragraph:

*In activewear not intended for use in water sports, such as workout wear, clothing manufacturers such as Reebok and Hind have used flatlock stitches incorporating fluffed fiber to create an ornamental appearance at the seams of adjacent panels of stretchable fabrics such as the fabric sold under the trade name Lycra and stretchable cotton. For example, Reebok used a seven threaded, fluffed fiber flatlock stitch on a small quantity of workout wear garments made exclusively of fabric sold under the trade name LYCRA. Six thread flatlock stitches incorporating fluffed fiber are also known for use in Lycra and Lycra/-*

*stretchable cotton garments. However, no flatlock stitches incorporating fluffed fiber are known to have been publicly used on garments made of material other than Lycra or stretchable cotton, such as the less flexible synthetic rubber (i.e., the fabric sold under the trade name NEOPRENE) commonly used in wet suits and other articles of clothing intended for use in water.*

AS A RESULT OF REEXAMINATION, IT HAS BEEN DETERMINED THAT:

The patentability of claims 1-10 is confirmed.

Claims 11-15 are cancelled.

Claim 16 is determined to be patentable as amended.

16. A seam for securing adjacent edges of two panels of material together in an article of clothing, *wherein at least one panel is formed of synthetic rubber,* comprising:

a series of parallel rows of straight stitches extending through the underlying panel material;

a transverse, serpentine cross-stitch on each face of the seam linking the stitches in adjacent rows; and the parallel and serpentine stitches being formed from four threads of non-fluffed fiber and three threads of fluffed fiber.

* * * * *